US006685505B1

(12) United States Patent
Espenshade et al.

(10) Patent No.: US 6,685,505 B1
(45) Date of Patent: Feb. 3, 2004

(54) ELECTRICAL CONNECTOR ASSEMBLY HAVING GROUND MEMBER

(75) Inventors: Leonard K. Espenshade, Harrisburg, PA (US); Kevin E. Walker, Hershey, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/236,615

(22) Filed: Sep. 6, 2002

(51) Int. Cl.[7] ..... H01R 13/66; H01R 13/648
(52) U.S. Cl. ..... 439/541.5; 439/607
(58) Field of Search ..... 439/541.5, 607, 439/608, 609, 610

(56) References Cited

U.S. PATENT DOCUMENTS 5,637,015 A * 6/1997 Tan et al. ..... 439/607
6,183,292 B1 2/2001 Chen et al.
6,478,610 B1 * 11/2002 Zhou et al. ..... 439/490
6,520,799 B1 * 2/2003 Cheng et al. ..... 439/541.5

* cited by examiner

*Primary Examiner*—Hung V. Ngo
(74) *Attorney, Agent, or Firm*—Wei Te Chung

(57) ABSTRACT

An electrical connector assembly (1) includes an insulative main housing (2), a stacked Universal Serial Bus (USB) connector (4) having a shell, a daughter printed circuit board (PCB) (7) carrying a plurality of signal conditioning components (71) and a ground member (5). The main housing defines a cavity (22) for receiving the USB connector. The ground member comprises a body portion (51) and a retention portion (53). The body portion electrically connects with the shell of the USB connector. The retention portion is mounted to the daughter PCB.

13 Claims, 9 Drawing Sheets

ELECTRICAL CONNECTOR ASSEMBLY HAVING GROUND MEMBER

CROSS-REFERENCE TO RELATED APPLICATION

The present application is related to a U.S. patent application entitled to "STACKED ELECTRICAL CONNECTOR ASSEMBLY HAVING EASILY DETACHABLE ELECTRONIC MODULE", invented by Leonard Kay Espenshade and Kevin Eugene Walker, the application entitled to "SHIELDED ELECTRICAL CONNECTOR ASSEMBLY HAVING RELIABLE GROUNDING CAPABILITIES", invented by Leonard Kay Espenshade, the application entitled to "STACKED CONNECTOR WITH LEDS AND METHOD OF PRODUCING THE SAME", invented by Kevin Eugene Walker and Leonard Kay Espenshade, the application entitled to "STACKED CONNECTOR WITH LEDS", invented by Leonard Kay Espenshade and Kevin Eugene Walker, the application entitled to "STACKED CONNECTOR WITH REAR COVER ASSEMBLED THERETO", invented by Kevin Eugene Walker, James Henry Hyland, Tod Martin Harlan and Robert William Brown, and the application entitled "SHIELDED ELECTRICAL CONNECTOR ASSEMBLY HAVING RELIABLE GROUNDING CAPABILITIES", contemporaneously filed and all assigned to the common assignee.

BACKGROUND OF THE INVENTION

1. Field of the Invention

The present invention relates to an electrical connector assembly, and more particularly to an electrical connector assembly having reliable grounding capabilities.

2. Description of the Related Art

In the electronics industry, electrical connectors are often mounted to printed circuit boards for electrical connection to circuit traces on the boards. The electrical connectors typically comprise housings, a plurality of contacts received in the housings and shields enclosing the housings for shielding against electromagnetic interference (EMI).

U.S. Pat. No. 6,162,089 issued to Costello et al discloses such an electrical connector. The Costello device is a stacked LAN connector adapted for mounting to a circuit board. The stacked LAN connector comprises a stacked USB component and a modular jack component received in respective portions of a main housing. An inner shield shields the arrays of contacts of the modular jack component and the stacked USB component.

U.S. Pat. No. 6,183,292 issued to Chen et al on Feb. 6, 2001 also discloses an electrical connector. The Chen device is an electrical connector assembly comprising an insulative housing 5, and a modular jack 1 and a stacked Universal Serial Bus (USB) connector 4 both received in the housing 5. The module jack 1 is mounted on a daughter printed circuit board (PCB) 2 carrying a signal conditioning component 3. A resilient contact pad 20 is mounted on the daughter PCB 2. The stacked USB connector 4 comprises a ground shell 43 to resiliently abut against the resilient contact pad 20, thereby establishing a ground connection between the stacked USB connector 4 and the daughter PCB 2.

However, if a certain component is mounted between the daughter PCB 2 and the stacked USB connector 4 for a certain purpose, it is impossible for the ground shell 43 to make contact with the contact pad 20 of the daughter PCB 2.

Hence, an improved electrical connector assembly is required to overcome the disadvantages of the prior art.

BRIEF SUMMARY OF THE INVENTION

A main object of the present invention is to provide an electrical connector assembly having a ground member connecting a connector with a daughter PCB.

An electrical connector assembly in accordance with the present invention is mounted on a mother printed circuit board (PCB) of an electrical device. The electrical connector comprises an insulative main housing defining a cavity, a stacked Universal Serial Bus (USB) connector received in the cavity of the main housing, a daughter PCB and a ground member. The stacked USB connector comprises a shell. The daughter PCB comprises a signal conditioning component and is parallel to the rear wall of the main housing. The ground member comprises a body portion electrically connecting with the shell of the USB connector, and a retention portion electrically connecting with the daughter PCB. Therefore, a continuous ground connection is thus established between the USB connector and the daughter PCB.

Other objects, advantages and novel features of the invention will become more apparent from the following detailed description when taken in conjunction with the accompanying drawings.

DETAILED DESCRIPTION OF THE INVENTION

Figure 1:
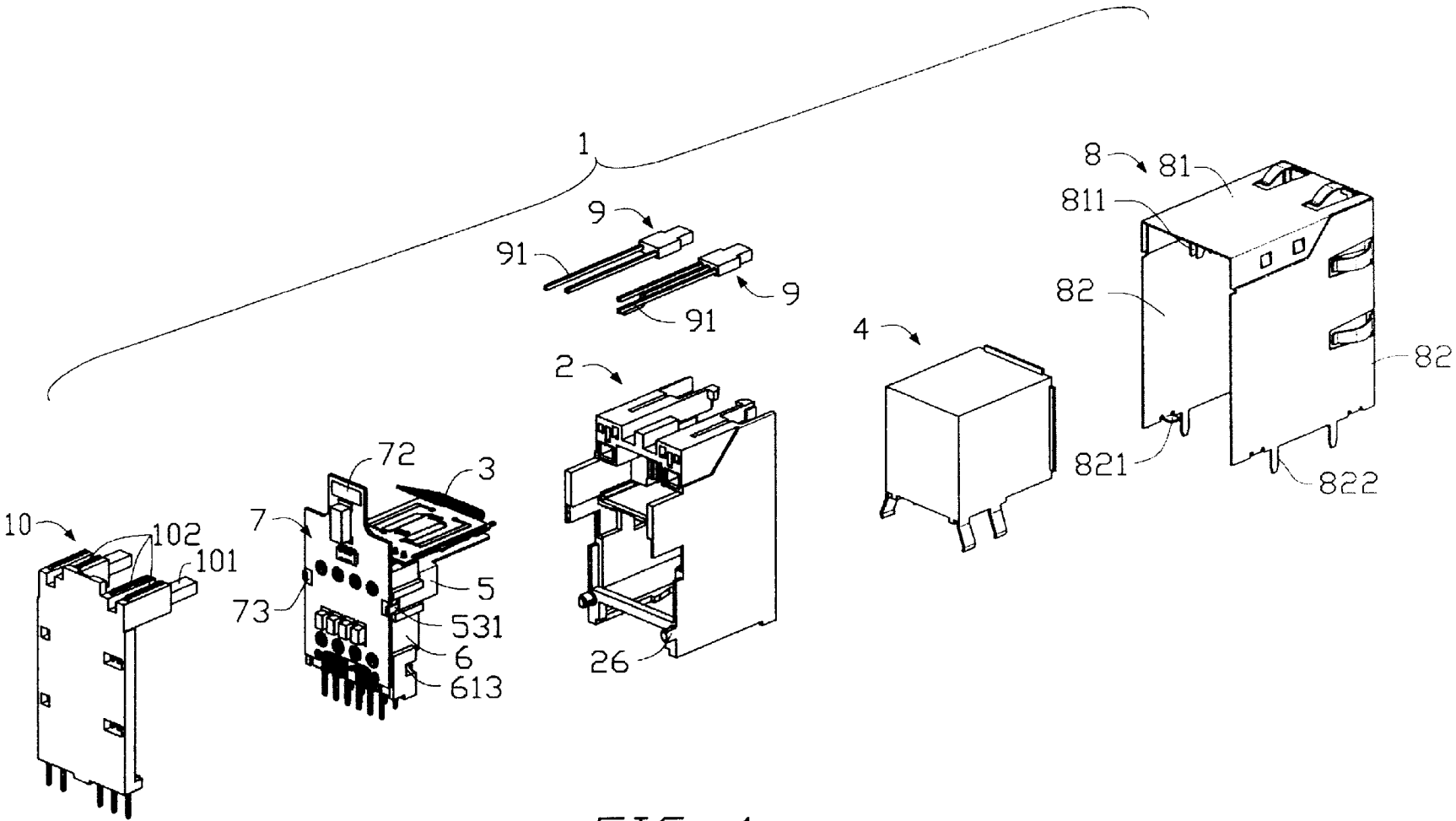
FIG. 1 is an exploded view of an electrical connector assembly according to the present invention.
Figure 2:
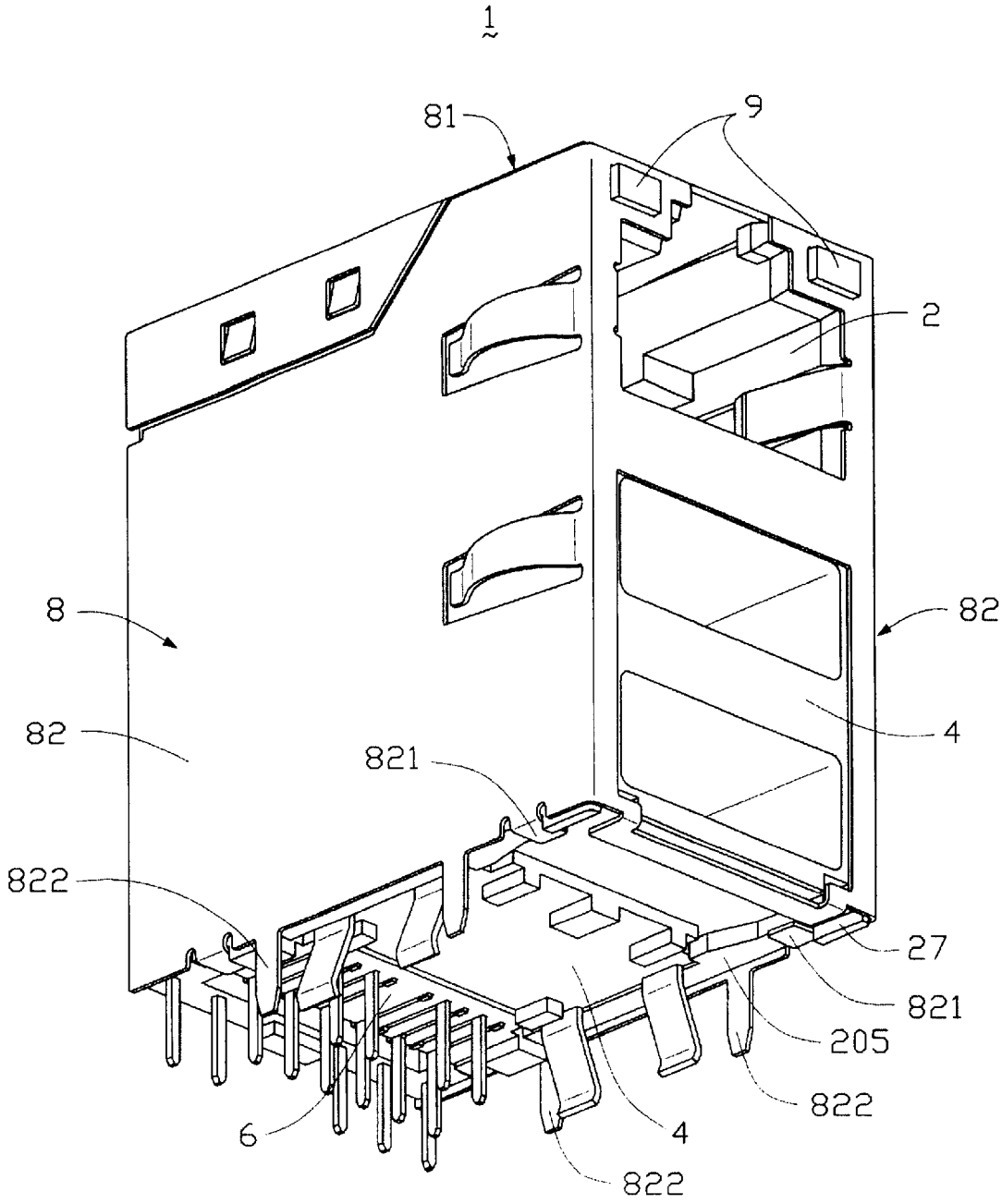
FIG. 2 is an assembled view of FIG. 1.
Figure 3:
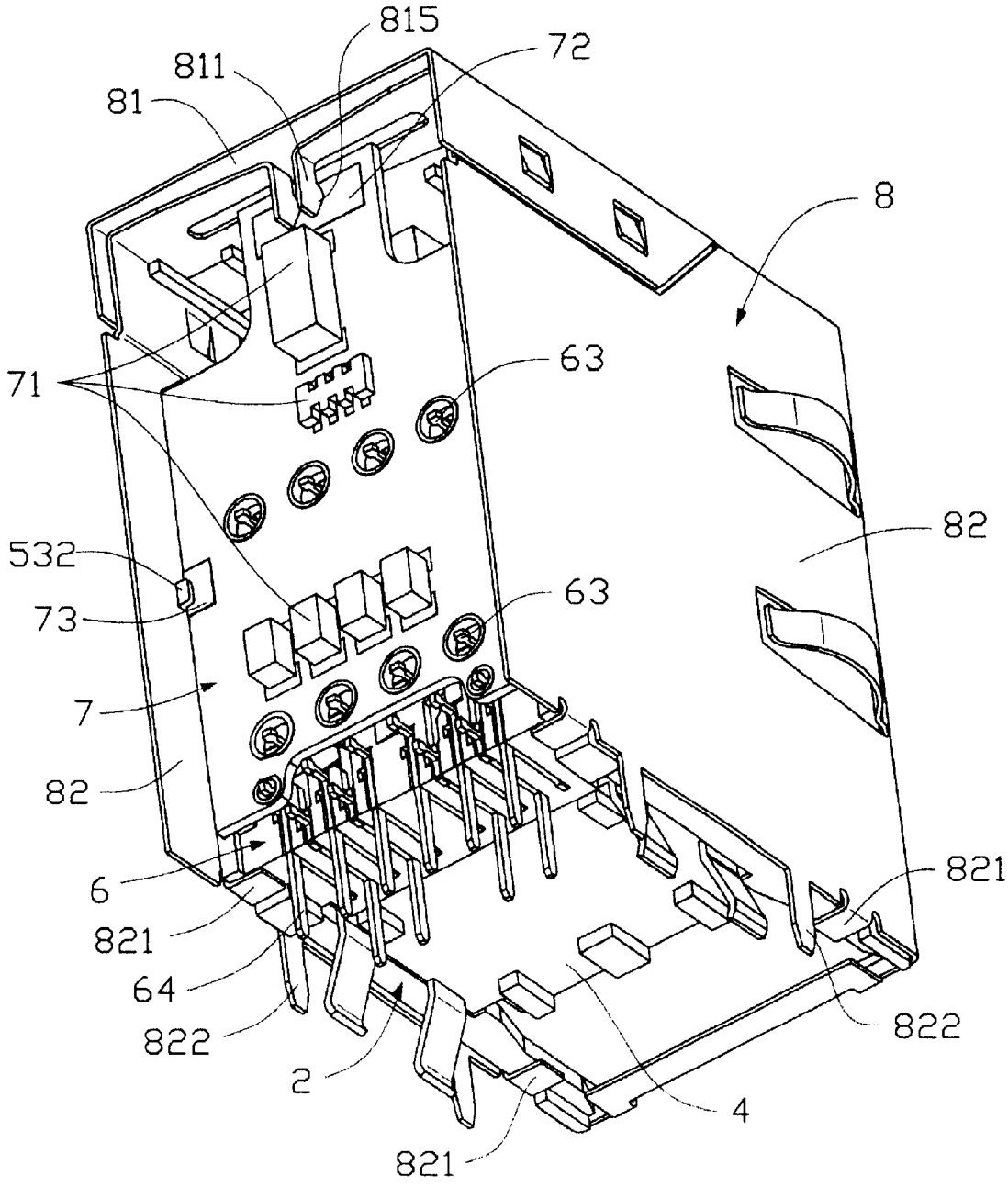
FIG. 3 is another assembled view of FIG. 1, with a rear cover removed for clarity.

Referring to FIGS. 1, 2 and 3, a stacked electrical connector assembly 1 according to the present invention comprises an insulative main housing 2, a contact module 3, a stacked Universal Serial Bus (USB) connector 4 comprising a metallic shell 41 (shown in FIG. 6), a ground member 5, a magnetic module 6 mounted on the main housing 2, a daughter printed circuit board (PCB) 7 mounted on the magnetic module 6, a metallic shield 8 substantially enclosing the main housing 2, a pair of Light Emitting Diodes (LEDs) 9 and a rear cover 10.

Figure 4:
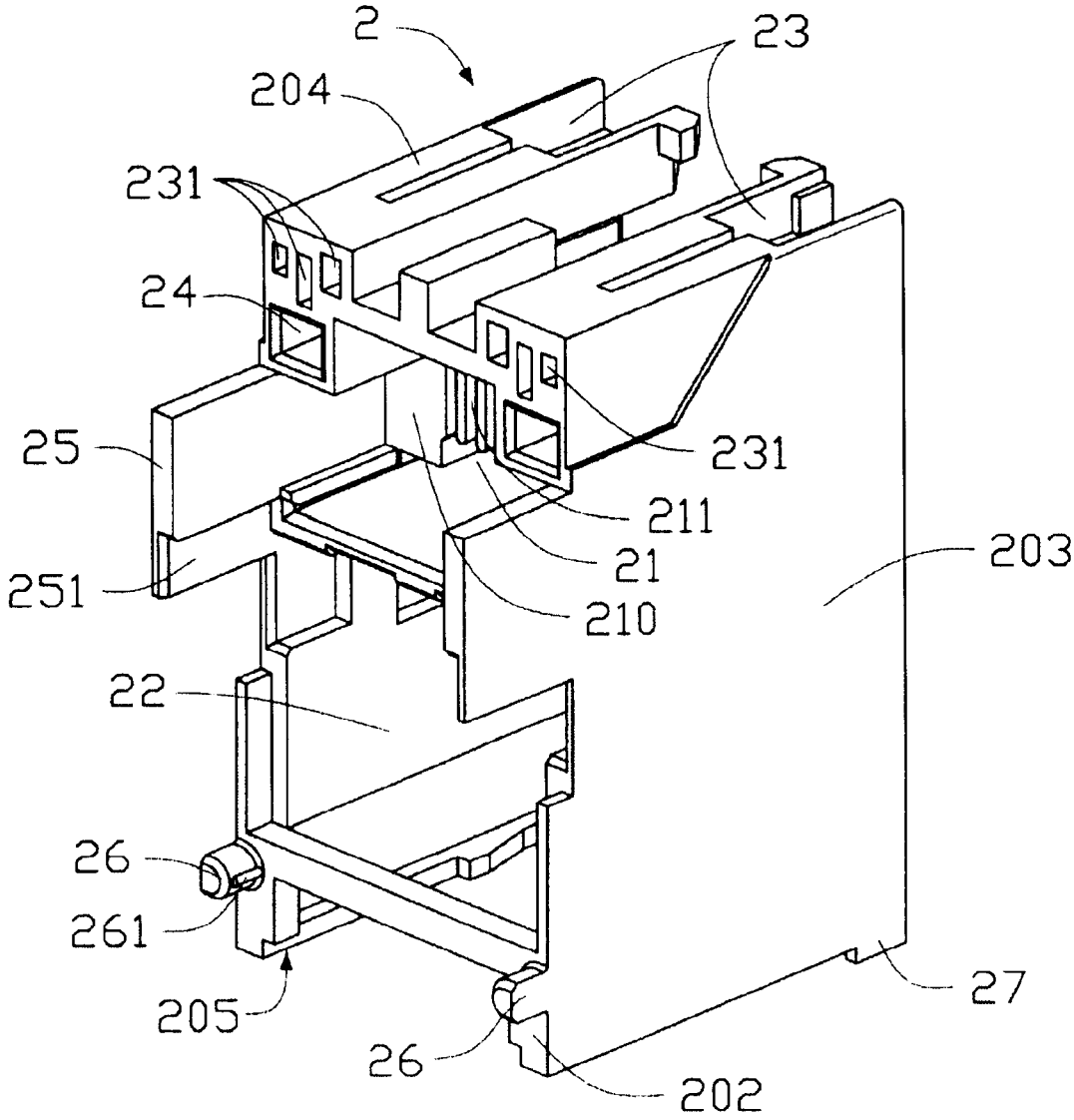
FIG. 4 is a perspective view of a main housing of the electrical connector assembly.
Figure 5:
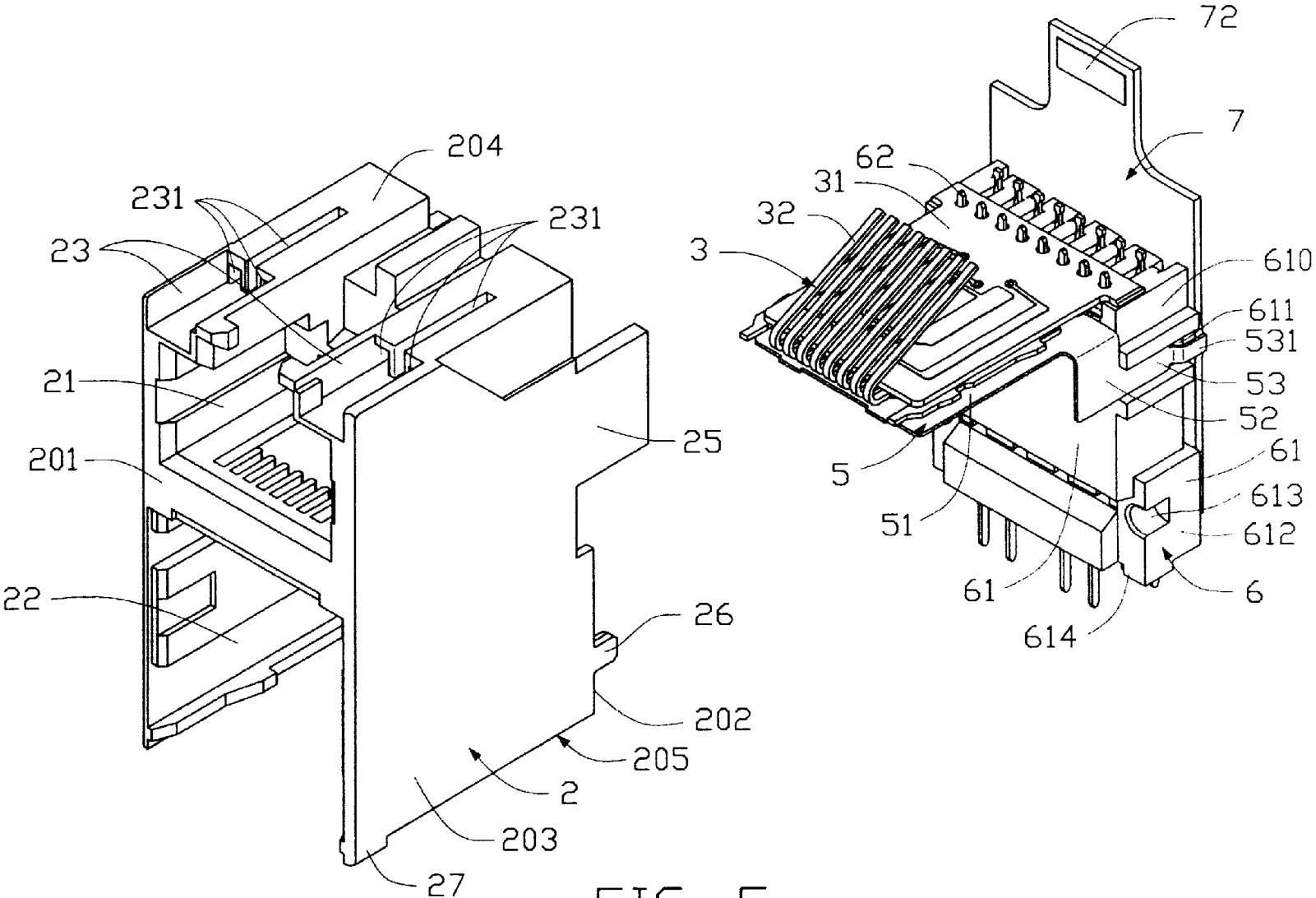
FIG. 5 is a partially view of the electrical connector assembly, showing the main housing, a contact module, a ground member, a magnetic module and a daughter printed circuit board (PCB) of the electrical connector assembly.

Referring to FIGS. 4 and 5, the main housing 2 is mounted on a mother printed circuit board (not shown, PCB) of an electrical device. The main housing 2 is substantially cubic and comprises a front wall 201, a rear wall 202, opposite sidewalls 203, a top wall 204 and a bottom wall 205. The main housing 2 defines an upper cavity 21 and a lower cavity 22. The upper cavity 21 is defined through the front and the rear walls 201, 202 for receiving the contact module 3. The lower cavity 22 is defined through the front, the rear and the bottom walls 201, 202, 205 for receiving the stacked USB connector 4. A comb portion 210 extends downwardly from the top wall 204 into the upper cavity 21. The comb portion 210 defines a plurality of parallel retaining slits 211 communicating with the upper cavity 21. A pair of spaces 23 are defined in opposite side portions of the front and the top walls 201, 204. A pair of groups of three channels 231 are respectively defined through the rear wall 202 and communicate with corresponding spaces 23. A pair of mating holes 24 are defined in the rear wall 202 adjacent to corresponding three channels 231 for fixing the rear cover 10. Each sidewall 203 comprises a flange 25 projecting rearwardly from an upper portion and beyond the rear wall 202. Each flange 25 defines a notch 251 in a lower portion of an inner face thereof. A pair of semicylindric retaining posts 26 project rearwardly from side portions of a lower portion of the rear wall 202. The retaining posts 26 align with corresponding flanges 25 with cylindrical surfaces thereof face to each other. Each retaining post 26 has an inwardly projecting ridge 261 extending longitudinally along the cylindrical surface thereof. A pair of stand-offs 27 downwardly project from the bottom wall 205 for mounting on the mother PCB of the electrical device.

The contact module 3 is received in the upper cavity 21 and comprises a horizontal compensation PCB 31 and a plurality of parallel conductive terminals 32 mounted on the compensation PCB 31. Each terminal 32 comprises an elongate solder section 321 soldered to a bottom surface of the compensation PCB 31, and a spring engaging section 322 inclinedly extending above a top surface of the compensation PCB 31 with a free end thereof retained in a corresponding retaining slit 211 of the main housing 2. The stacked USB connector 4 comprising a metallic shell 41 is received in the lower cavity 22 of the main housing 2.

Figure 6:
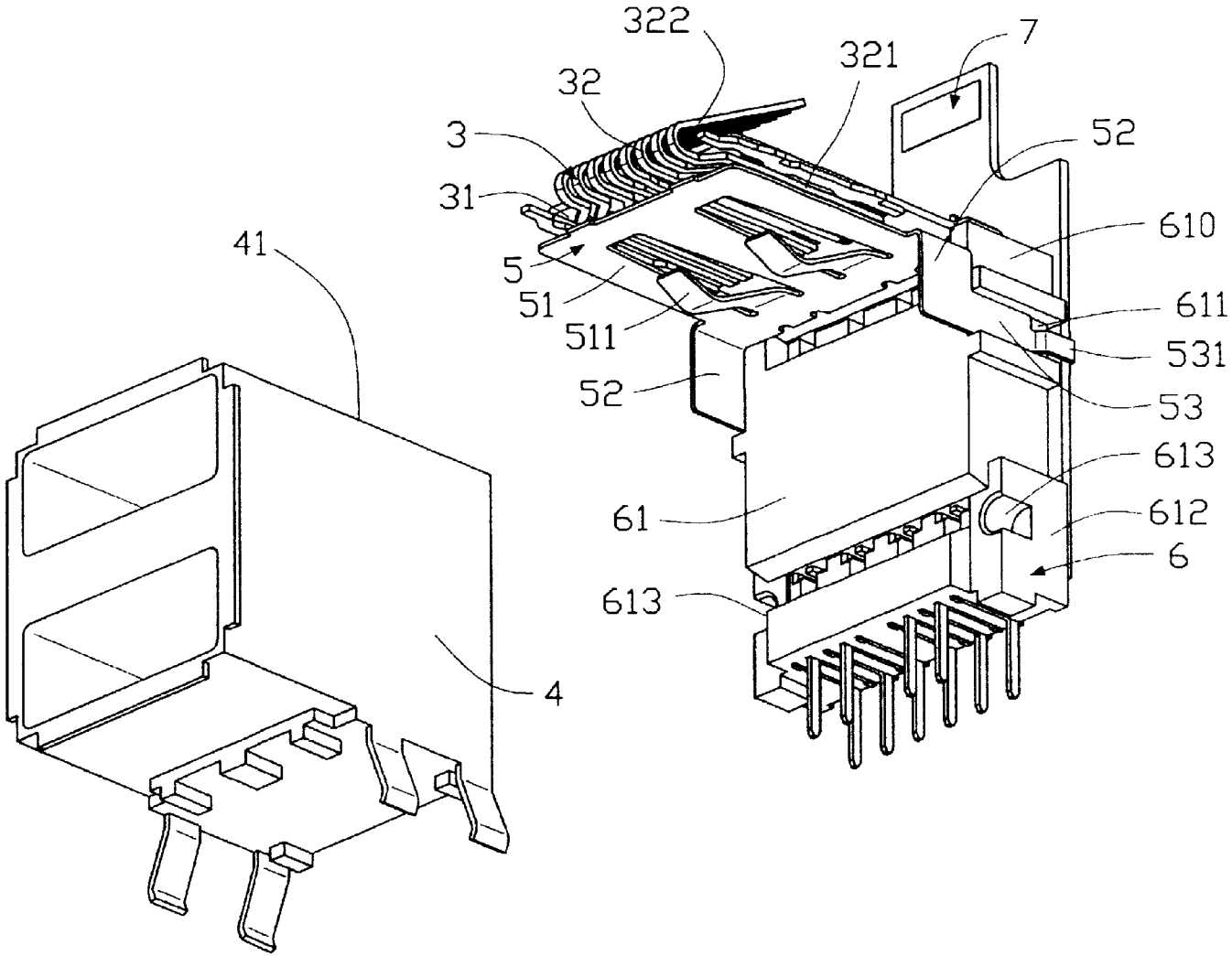
FIG. 6 is another partially view of the electrical connector assembly, showing the contact module, the ground member, the magnetic module, the daughter PCB and a stacked Universal Serial Bus (USB) connector of the electrical connector assembly.
Figure 7:
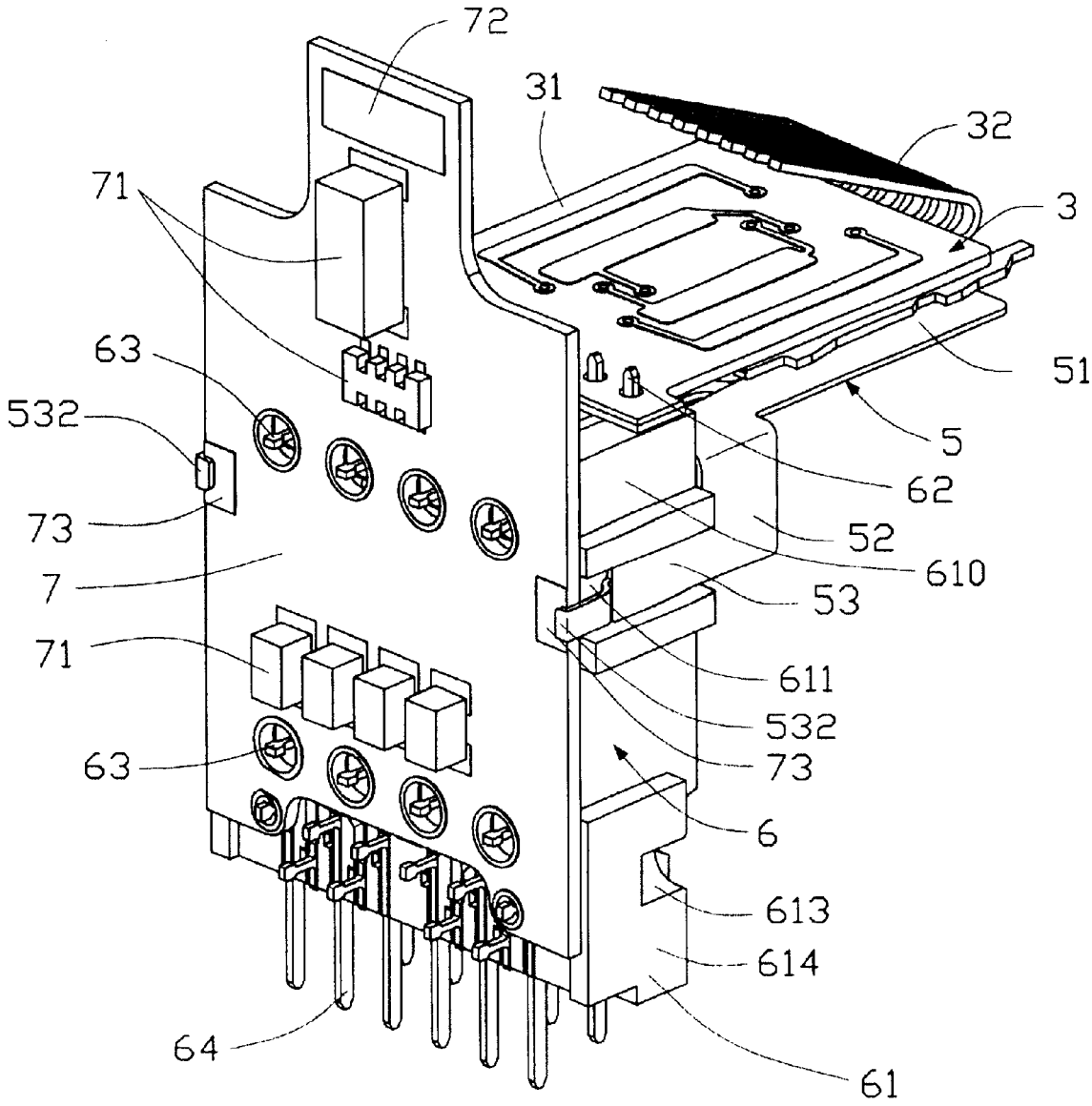
FIG. 7 is a further partially view of the electrical connector assembly, showing the contact module, the ground member, the magnetic module and the daughter PCB of the electrical connector assembly.

Referring to FIGS. 6 and 7, the ground member 5 is fabricated from a conductive metal sheet and comprises a rectangular body portion 51, a pair of upright linking portion 52 downwardly depending from rear portions of opposite side edges of the body portion 51 and a pair of retention portions 53 rearwardly extending from rear edges of corresponding linking portions 52. The body portion 51 is stamped out a pair of spring fingers 511 with free ends substantially extending forwardly and downwardly. The body portion 51 is inserted in the lower cavity 22 with spring fingers 511 elastically abutting against an upper face of the metallic shell 41 of the stacked USB connector 4. A retention tail 531 extends slightly and outwardly from a rear portion of each retention portion 53, with a distal end 532 inwardly bent to clinch over the daughter PCB 7.

Figure 8:
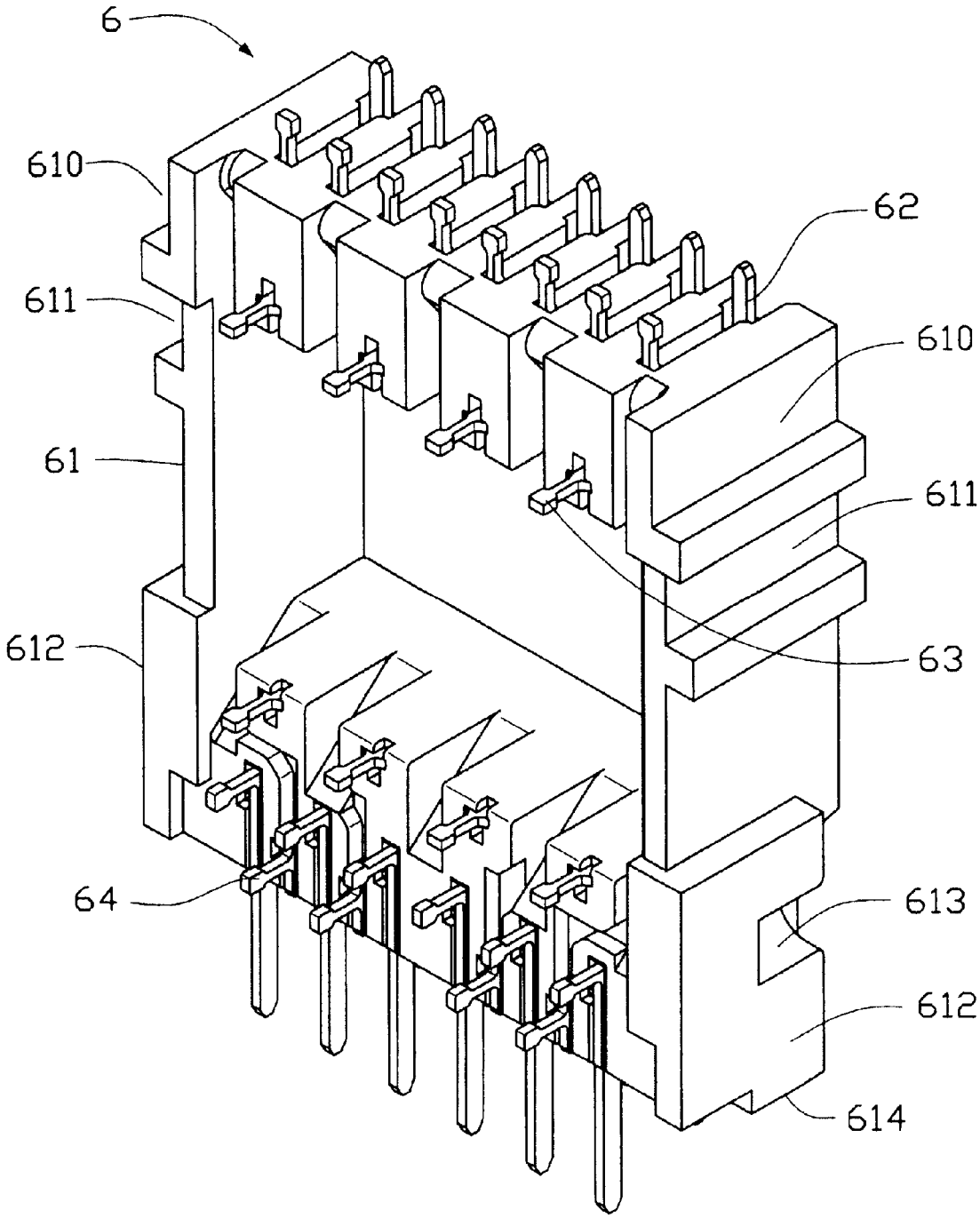
FIG. 8 is a perspective view of the magnetic module of the electrical connector assembly.

Referring to FIGS. 7 and 8, the magnetic module 6 is mounted onto the rear wall 202 of the main housing 2 and comprises an insulative receptacle portion 61, a plurality of first, second and third contacts 62, 63 and 64 retained by the receptacle portion 61. The receptacle portion 61 is substantially cubic and receives a plurality of magnetic coils (not shown) interconnecting the first, the second and the third contacts 62, 63 and 64 in a certain manner.

A pair of recesses 610 are respectively defined in an upper portion of opposite sidewalls 612 of the receptacle portion 61 for facilitating engaging with the notches 251 of the main housing 2, thereby retaining the magnetic module 6 on the main housing 2. The receptacle portion 61 horizontally defines a pair of grooves 611 in a middle portion of corresponding opposite sidewalls 612 for retaining corresponding retention portions 53 of the ground member 5 therein. A pair of semicylindric retaining cutouts 613 are respectively defined in lower portions of the sidewalls 612. The retaining cutouts 613 expose forwardly for engaging with corresponding retaining posts 26 of the main housing 2, whereby the magnetic module 6 is mounted on the main housing 2. A pair of stand-offs 614 downwardly extend from a bottom surface of the receptacle portion 61 for mounting on the mother PCB.

The first contacts 62 extend beyond a top surface of the receptacle portion 61 to electrically connect with the compensation PCB 31 of the contact module 3. The second contacts 63 project from a rear surface of the receptacle portion 61 to electrically connect with the daughter PCB 7. The third contacts 64 project beyond a bottom surface of the receptacle portion 61 to solder to the mother PCB.

Particularly referring to FIGS. 6, and 7, the daughter PCB 7 is mounted on a rear surface of the receptacle portion 61 of the magnetic module 6 and carries a plurality of signal conditioning components 71 on a rear surface thereof for eliminating undesirable extraneous signals such as high frequency noises. A pair of contact pads 72 are attached on top portions of opposite surfaces of the daughter PCB 7. A pair of conductive connection pads 73 are formed on side portions of the rear surface of the daughter PCB 7, whereby the distal ends 532 of the retention tails 531 of the ground member 5 clinches thereon and electrically connect with the daughter PCB 7. Therefore, a continuous ground connection is established between the stacked USB connector 4 and the daughter PCB 7.

Figure 9:
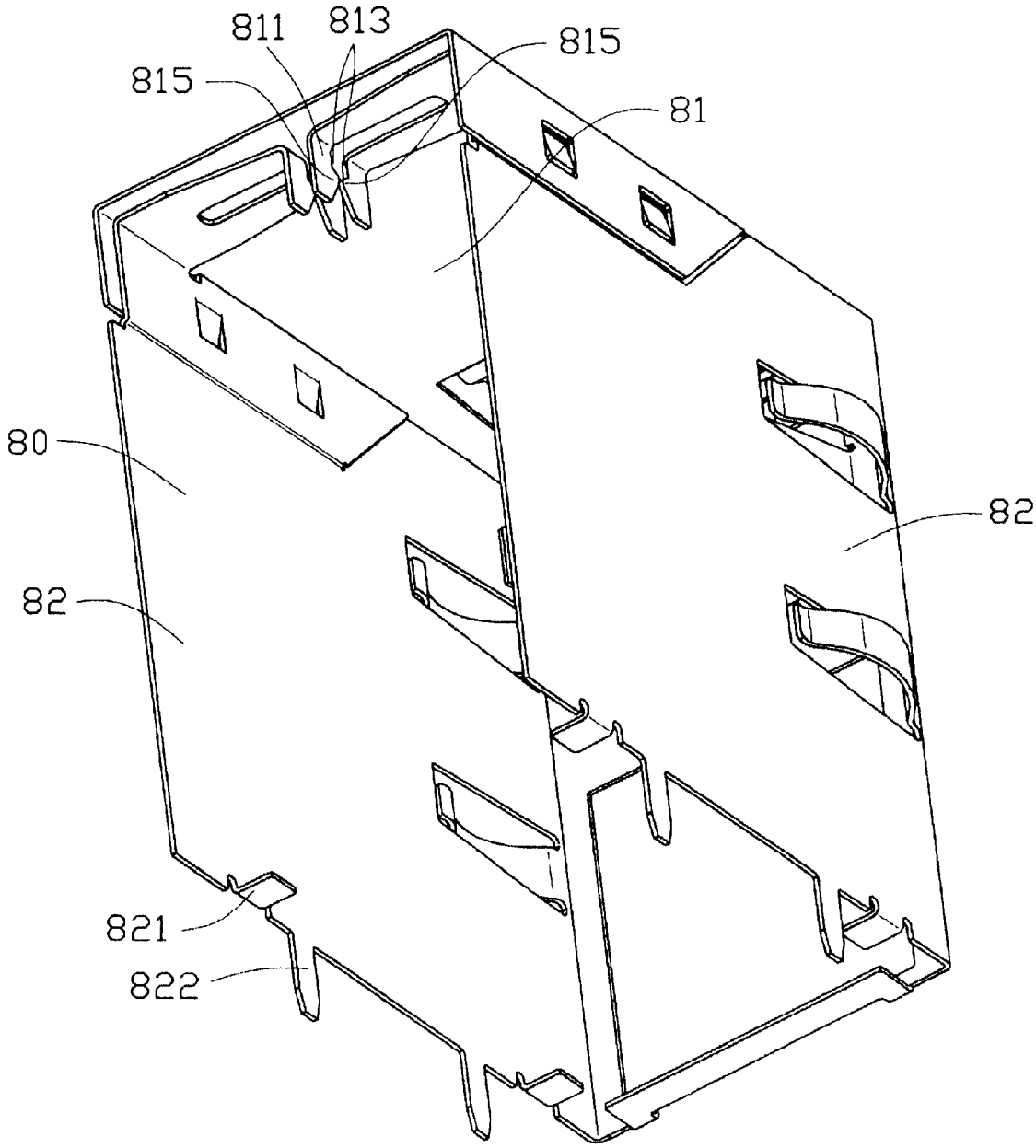
FIG. 9 is a perspective view of a shield of the electrical connector assembly.

Referring to FIGS. 3 and 9, the shield 8 comprises a top wall 81 and opposite side walls 82. A chamber 80 is defined by the top wall 82 and the side walls 82 for substantially enclosing the main housing 2, the magnetic module 6 and the daughter PCB 7. The top wall 81 comprises an upper layer (not labeled) and a lower layer (not labeled). Two pairs of contacting legs 811 depend downwardly from a rear portion of the lower layer of the top wall 81 and are arranged in two juxtaposed lines. Each pair of contacting legs 811 is parallel to the side wall 82 of the shield 8 with inner side edges 813 facing to each other. A pair of contacting feet 815 are respectively formed on the inner side edges 813 of each pair of contacting legs 811 and project to each other for securely clamping the upper portion of the daughter PCB 7 therebetween, thereby electrically contacting corresponding contact pads 72 of the daughter PCB 7. Each side walls 82 form a pair of downwardly projecting mounting legs 822 for soldering to the mother PCB. Therefore, a continuous ground connection is established between the daughter PCB 7 and the mother PCB. Each side walls 82 also forms a pair of retention tabs 821 inwardly bent to abut against the bottom wall 205 of the main housing 2 for retaining the shield 8 with the main housing 2.

Referring to FIGS. 1 and 4, the LEDs 9 are respectively received in the spaces 23 of the main housing 2 with tails 91 rearwardly extending through corresponding channels 231.

The rear cover 10 comprises a pair of forwardly projecting mating poles 101 for engaging with the mating holes 24 of the main housing 2 and a plurality of contacts 102 extending forwardly to electrically connect with corresponding tails 91 of the LEDs 9.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an insulative main housing comprising a front wall and a rear wall, the main housing defining a cavity extending from the front wall to the rear wall;

a shielded connector received in the cavity of the main housing and comprising a metallic shell;

a daughter printed circuit board (PCB) assembled to the main housing and forming a connection pad; and a ground member comprising a body portion electrically connecting with the shell of the shielded connector and a retention portion extending from the body portion to electrically connect with the daughter PCB, the retention portion comprising a retention tail, the retention tail electrically connecting the connection pad of the daughter PCB to establish electrical connection between the ground member and the daughter PCB.

2. The electrical connector assembly as claimed in claim 1, wherein the body portion of the ground member is perpendicular to the daughter PCB, and comprises a spring finger being stamped out to electrically and resiliently abut against a top surface of the shell of the connector.

3. The electrical connector assembly as claimed in claim 1, wherein the retention tail forms an inwardly bent distal end clinching over the connection pad of the daughter PCB.

4. The electrical connector assembly as claimed in claim 1, wherein the body portion of the ground member is received in the cavity of the main housing.

5. The electrical connector assembly as claimed in claim 1, further comprising a magnetic module sandwiched between the connector and the daughter PCB.

6. The electrical connector assembly as claimed in claim 5, wherein the magnetic module defines a groove retaining the retention portion of the ground member.

7. The electrical connector assembly as claimed in claim 1, wherein the shielded connector is a stacked Universal Serial Bus (USB) connector.

8. A ground system of an electrical connector comprising:

a metallic shell;

a daughter PCB extending in a first direction; and a ground member comprising a body portion electrically connecting with the metallic shell and a retention portion electrically connecting with the daughter PCB, the body portion extending in a second direction perpendicular to the first direction, the retention portion extending in a third direction opposite to the second direction.

9. The ground system of the electrical connector as claimed in claim 8, wherein the body portion of the ground member comprises a spring finger projecting towards the shell and resiliently and electrically connecting the metallic shell.

10. The ground system of the electrical connector as claimed in claim 8, wherein the retention portion forms a retention tail electrically connecting the daughter PCB.

11. The ground system of the electrical connector as claimed in claim 8, further comprising a shield enclosing the metallic shell, the daughter PCB and the ground member, the shield electrically connecting with the daughter PCB.

12. A daughter printed circuit board assembly for use with an electrical connector having upper and lower cavities thereof, comprising:

a vertical daughter printed circuit board;

a horizontally extending compensation printed circuit board perpendicular to the daughter printed circuit board;

a plurality of juxtaposed terminals mounted on the compensation printed circuit board;

a magnetic module mechanically and electrically connected to both the compensation printed circuit board and the daughter printed circuit board, respectively; and a grounding member dimensioned similar to the compensation printed circuit board and located under the compensation printed circuit board in a parallel relation.

13. The assembly as claimed in claim 12, wherein a plurality of terminals extend from a lower portion of the magnetic module for mounting to a mother printed circuit board parallel to the compensation printed circuit board.

* * * * *